United States Patent [19]

Kosicki et al.

[11] 4,166,337

[45] Sep. 4, 1979

[54] DOLL WITH HEARTBEAT SIMULATOR

[75] Inventors: Witold W. Kosicki, Columbia; Charles J. Corris, Irmo; Robert T. Potter, Columbia, all of S.C.

[73] Assignee: Horsman Dolls Inc., Columbia, S.C.

[21] Appl. No.: 813,501

[22] Filed: Jul. 7, 1977

[51] Int. Cl.[2] ..... A63H 33/26

[52] U.S. Cl. ..... 46/232; 46/264; 46/117

[58] Field of Search ..... 46/232, 264, 228, 248, 46/265, 268, 116, 117, 141, 227, 189; 128/1 C; 35/17

[56] References Cited

U.S. PATENT DOCUMENTS

| | | | |
|---|---|---|---|
| 2,154,121 | 4/1939 | Bold | 46/141 |
| 2,653,411 | 9/1953 | Beltz | 46/141 X |
| 2,757,480 | 8/1956 | Uchill | 46/117 |
| 2,954,642 | 10/1960 | Jackson | 46/232 |
| 3,014,312 | 12/1961 | Convertine | 46/264 |
| 3,024,568 | 3/1962 | Barnett | 46/232 |
| 3,119,200 | 1/1964 | Curtin et al. | 46/232 |
| 3,232,004 | 2/1966 | Felsher | 46/232 X |
| 3,888,233 | 6/1975 | Ware | 46/232 X |
| 3,994,282 | 11/1976 | Moulet | 46/232 X |

FOREIGN PATENT DOCUMENTS

| | | | |
|---|---|---|---|
| 995974 | of 1965 | United Kingdom | 46/264 |

*Primary Examiner*—Louis G. Mancene
*Assistant Examiner*—Mickey Yu
*Attorney, Agent, or Firm*—Shenier & O'Connor

[57] ABSTRACT

A heartbeat simulator for a toy doll or the like comprises a resilient, relatively soft rubber diaphragm supported at its edges in a housing and formed with curved surface portions to provide a popping movement between an equilibrium position and a displaced position. A motor is periodically energized to displace the diaphragm by winding a cord attached at one end to the motor shaft and at the other end to the diaphragm and is immediately thereafter de-energized to permit the diaphragm to unwind the cord and return to its equilibrium position. A connecting tube acoustically couples the diaphragm to the mouth of the toy doll to produce a simultaneous breathing sound.

15 Claims, 4 Drawing Figures

DOLL WITH HEARTBEAT SIMULATOR

BACKGROUND OF THE INVENTION

There are several known devices for simulating the sound of a heartbeat. None of these devices, however, has proven to be entirely successful for this purpose. For example, U.S. Pat. No. 3,888,233, issued to Ware, shows a dynamic loudspeaker driven by an oscillator producing periodic pulses. Unless adequate acoustical muffling or pulse-shaping circuitry is provided, the sound produced will be strident and tinny in character and will not resemble the distinctive low-frequency thumping sound of an actual heartbeat. Further, the fragility and limited excursion of a typical loudspeaker tends to result in an audible but not palpable heartbeat.

Another patent, U.S. Pat. No. 3,119,200, issued to Curtin et al, discloses an assembly having a diaphragm and a moving coil that is specially designed to simulate a heartbeat. While such an assembly may be more suitable than an ordinary loudspeaker, the complicated valving and switching arrangement militates against successful commercial exploitation.

SUMMARY OF THE INVENTION

One of the objects of our invention is to provide a heartbeat simulator for a doll which faithfully reproduces the sound of a human heartbeat.

Another object is to produce a heartbeat simulator which produces a palpable heartbeat.

Still another object is to produce a heartbeat simulator which simultaneously produces a breathing sound.

A further object is to produce a heartbeat simulator which is simple but reliable.

Other and further objects will be apparent from the following description.

In general, our invention comprises a heartbeat simulator having a housing to the wall of which we secure a resilient diaphragm formed with curved surface portions to provide a popping movement from an equilibrium position to a displaced position. Periodically, a force is applied to the diaphragm for a sufficient period of time to move the diaphragm to its displaced position and is then removed to permit the diaphragm to return to its equilibrium position. Preferably, the force applying means comprises a motor which is intermittently energized to wind up one end of a cord, the other end of which is attached to the diaphragm. A hollow tube connects the interior of the housing behind the diaphragm to the mouth of the doll to simulate breathing.

DETAILED DESCRIPTION OF THE PREFERRED EMBODIMENT

Figure 1:
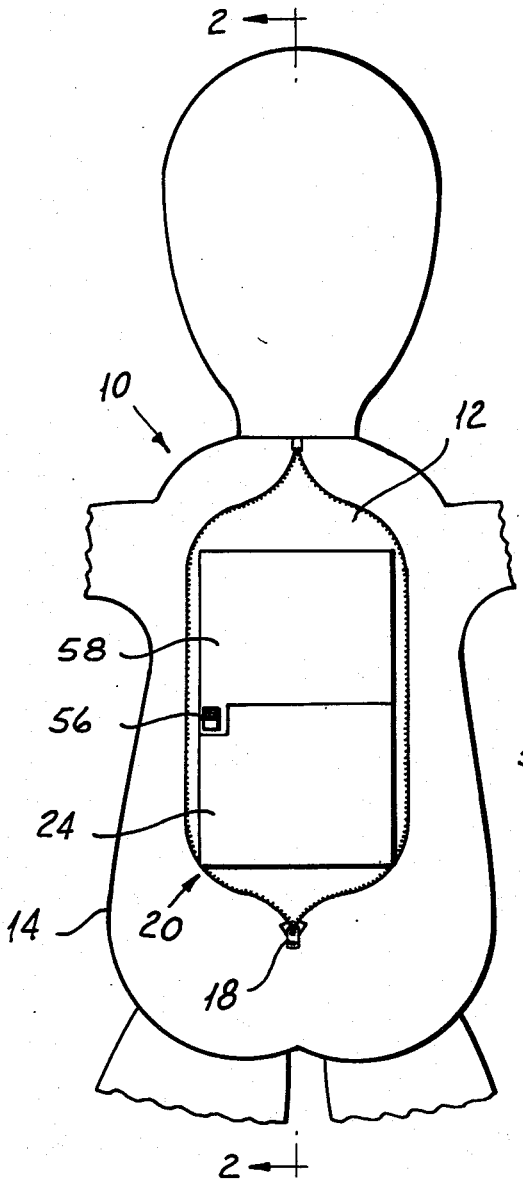
FIG. 1 is a fragmentary rear elevation of a doll including our heartbeat simulator.
Figure 2:
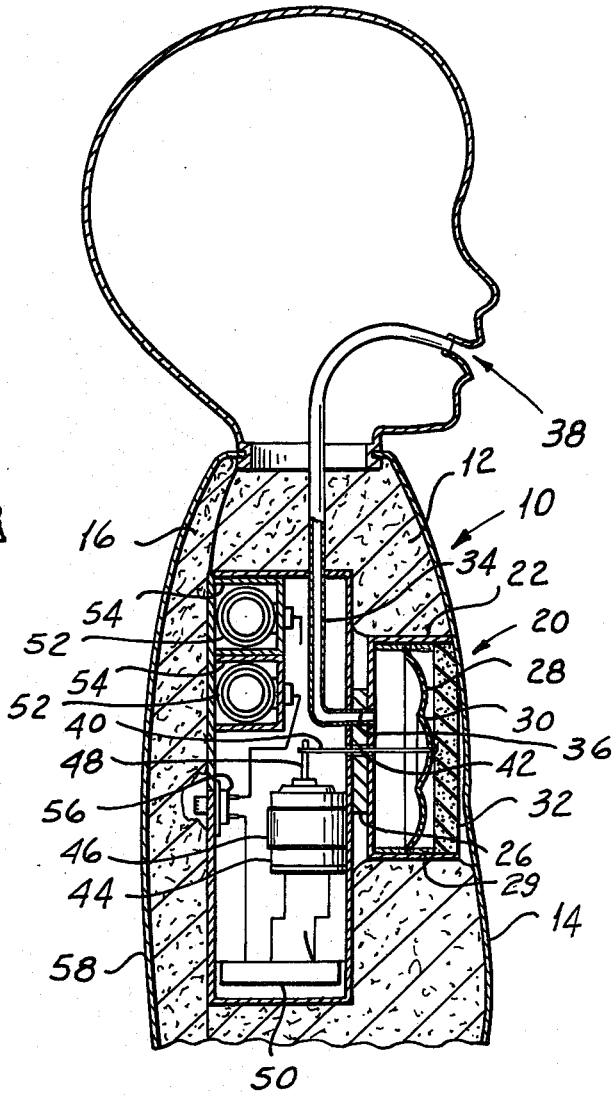
FIG. 2 is a section, taken along line 2—2, of the doll shown in FIG. 1.
Figure 3:
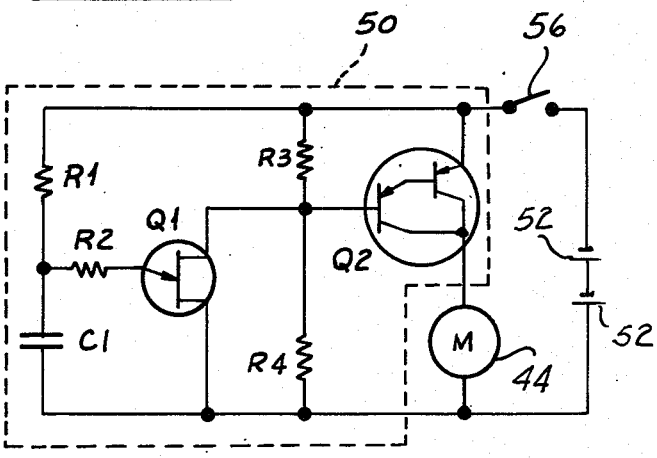
FIG. 3 is a schematic diagram of the control circuit of the simulator shown in FIGS. 1 and 2.
Figure 4:
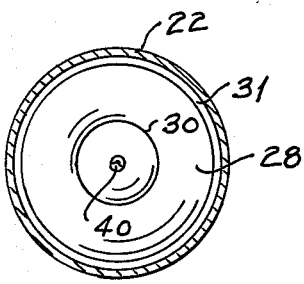
FIG. 4 is a fragmentary section of a portion of out heartbeat simulator.

Referring to the drawings, our doll, indicated generally by the reference character 10, comprises a foam filling 12 of polyethylene or the like encased in a cloth or plastic skin 14. Our hearbeat mechanism, indicated generally by the reference character 20, rests in a suitable cutout formed in the trunk portion of the foam 12 and is backed by a rear foam piece 16. The assembly 20 is accessible from the rear for switching it on and off, replacing batteries, and the like by opening a zipper 18 and removing the rear foam piece 16. The mechanism 20 includes a cylindrical acoustical housing 22 flush with the chest portion of the skin 14. A rectangular housing 24 joined to the acoustical housing 22 by a spacer member 26 contains the electrical and mechanical components of the mechanism 20. We dispose a soft rubber diaphragm 28 having one or more circumferential corrugations 30 within the cylindrical housing 22 set back somewhat from its outer end. Any suitable means such as rings 29 or the like may be employed to secure the edge of the diaphragm 28 to the wall of housing 22. The diaphragm 28 is formed from a resilient, relatively soft material such as nylon or rubber with a durometer hardness of about 45. We form the diaphragm 28 with a central portion and an outer portion having different curvatures and meeting to form corrugation 30. The rings 29, which may be adhered to the housing wall, engage a flat peripheral flange 31 of diaphragm 28. This construction is such that the diaphragm flexes rather than stretches as the center of the diaphragm is moved toward the back of housing 22. The bowed construction of the diaphragm further causes it to pop in and pop out so as to produce a characteristic low-frequency thump closely simulating a human heartbeat. A pad 32 formed of polyethylene foam similar to the foam 12 protects the diaphragm 28 from possible damage. A hollow tube 34 passes through a hole 36 in the back of the housing 22 to connect the interior of the housing 22 to the doll's mouth opening 38. As a result, the doll 10 emits a breathing sound simultaneously with the heartbeat.

We connect the center of diaphragm 28 to the shaft 48 of a motor 44 by means of a cord 40, such as a braided nylon cord, passing through a hole 42. Motor 44, which is secured to a wall of the electrical housing 24 by a suitable bracket 46, is intermittently energized at periodic intervals to wind the cord 40 around the shaft 48 to pull the diaphragm 28 inward until it abuts the closed inner end of the acoustical housing 22. The motor 44 is then disabled to allow the resilience of the diaphragm 28 to unwind the cord 40 so that the diaphragm 28 returns to its equilibrium position, but at a slower rate than its inward stroke. The rapid inward stroke coupled with the slower outward stroke of the diaphragm 28 results in a sound closely simulating that of a true heartbeat.

We intermittently energize motor 44 by means of a control circuit 50 disposed inside the electrical housing 24. Circuit 50, which is preferably constructed on a printed circuit board, is powered by a pair of series-connected 1.5-volt batteries 52 disposed in battery compartments 54. Housing 24 is formed with a removable rear wall portion 58 to permit access to the batteries 52. Actuation of a slide switch 56 mounted on the rear wall portion 28 disconnects the batteries from the circuit 50 during periods of nonuse.

Control circuit 50 comprises a unijunction transistor Q1 used as a relaxation oscillator to drive a power transistor Q2. Transistor Q2 is preferably of the type in which two transistor units, housed in a single casing, are coupled in a Darlington configuration.

At the beginning of an oscillation cycle, with transistor Q1 reverse-biased, the biasing circuit comprising resistors R3 and R4 provides a sufficiently positive potential to the base of transistor Q2 to cut it off and render it nonconductive. Capacitor C1 then charges through resistor R1 until the potential across capacitor C1 is high enough to fire transistor Q1. At this point, capacitor C1 discharges through resistor R2 and the emitter-base 1 junction of transistor Q1. At the same time, base 2 of transistor Q1 drops nearly to ground potential to drive transistor Q2 into saturation and energize motor 44. Resistor R2 prolongs the discharge of capacitor C1 for a sufficient time to energize motor 44 over a proper period. When capacitor C1 discharges to about 0.6 volts, transistor Q1 again becomes reverse-biased and a new oscillation cycle starts. The pulse frequency and duration may be varied by suitably adjusting the values of R1, R2, and C1.

It will be seen that we have accomplished the objects of our invention. Because of its bowed construction, the rubber diaphragm of our simulator produces a popping sound closely simulating a human heartbeat. Our simulator produces a simultaneous breathing sound. Our simulator, while relatively simple, is less fragile and thus more reliable than simulations of the prior art using paper diaphragms.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a doll, a heartbeat simulator comprising a diaphragm of resilient material, means mounting said diaphragm in said doll for movement between an equilibrium position and a displaced position, the construction and rrangement of said diaphragm being such as to provide a popping sound in the course of its movement both from said equilibrium position to said displaced position and from said displaced position back to said equilibrium position, and means for applying a force to said diaphragm in such a direction and for a sufficient period of time to move said diaphragm to said displaced position and then removing said force to permit the diaphragm to return to its equilibrium position under the action of the resilience of said resilient material, the relationship between said force applying means and the resilience of said material being such that said diaphragm moves more rapidly from one of said positions to the other than from said other position to the one whereby the sound produced in the course of one cycle of movement of said diaphragm closely resembles a human heartbeat sound, said force applying means applying said force at periodic intervals approximating those of a human heartbeat.

2. A simulator as in claim 1 in which said mounting means secures the edge of said diaphragm in a fixed position.

3. A simulator as in claim 1 in which said diaphragm has a durometer hardness of approximately 45.

4. A simulator as in claim 1 in which said force applying means comprises a rotary motor, a cord having one end attached to said diaphragm and the other end attached to the shaft of said motor, and means for periodically energizing said motor to wind the cord on said shaft and pull said diaphragm toward said motor.

5. A simulator as in claim 1 in which said diaphragm offers a decreasing resilient restoring force over a portion of its movement from said equilibrium position to said displaced position.

6. A simulator as in claim 1 in which said diaphragm has a nonplanar surface.

7. A simulator as in claim 1 in which said diaphragm has curved surface portions.

8. A simulator as in claim 1 in which said diaphragm has a radially symmetric circumferentially corrugated surface.

9. A heartbeat simulator as in claim 1 in which said diaphragm has a portion with a curved cross-sectional shape, said portion reversing its curvature in the course of movement of said diaphragm from said equilibrium position to said displaced position to produce said popping sound.

10. A simulator as in claim 1 in which said mounting means includes a housing forming a closed cavity enclosing one side of said diaphragm.

11. A simulator as in claim 10 in which said doll is formed with an opening at the mouth, said simulator comprising means for providing an air passage through the interior of said doll between the interior of said closed cavity and said mouth opening.

12. A simulator as in claim 11 in which said means for providing an air passage comprises a hollow tube.

13. A simulator as in claim 1 in which said doll comprises a skin layer, said diaphragm being recessed from said skin layer.

14. A simulator as in claim 13, further comprising a foam layer disposed between said diaphragm and said skin layer.

15. A simulator as in claim 13, further comprising means for mechanically coupling the movement of said diaphragm to said skin layer.

* * * * *